US006880685B2

(12) United States Patent
Fenton et al.

(10) Patent No.: US 6,880,685 B2
(45) Date of Patent: Apr. 19, 2005

(54) GUSSET FOR A LIGHT-WEIGHT BAG AND A BAG ASSEMBLED THEREFROM

(75) Inventors: Timm J. Fenton, Lebanon, NJ (US); Paul V. Scicluna, Penndel, PA (US); Dick H. Powell, London (GB)

(73) Assignee: Tumi, Inc., South Plainfield, NJ (US)

( * ) Notice: Subject to any disclaimer, the term of this patent is extended or adjusted under 35 U.S.C. 154(b) by 0 days.

(21) Appl. No.: 10/347,541

(22) Filed: Jan. 17, 2003

(65) Prior Publication Data

US 2004/0140170 A1 Jul. 22, 2004

(51) Int. Cl.[7] ..... A45C 5/14; A45C 13/00; A45C 13/36

(52) U.S. Cl. ..... 190/124; 190/18 A; 190/125; 190/127; 150/127; 150/129; 150/130; 383/119

(58) Field of Search ..... 190/18 A, 24, 190/124, 125, 126, 127; 150/127–130; 383/119, 120

(56) References Cited

U.S. PATENT DOCUMENTS

| | | | | | |
|---|---|---|---|---|---|
| 1,618,955 | A | * | 2/1927 | Gotisar | 190/114 |
| 3,159,253 | A | * | 12/1964 | Breault | 190/119 |
| 3,185,271 | A | * | 5/1965 | Kotkins | 190/113 |
| 3,306,403 | A | * | 2/1967 | Heitler et al. | 190/115 |
| 3,477,553 | A | * | 11/1969 | Kish, Jr. | 190/119 |
| 5,004,091 | A | * | 4/1991 | Natho et al. | 190/18 R |
| 5,065,847 | A | * | 11/1991 | Hsieh | 190/125 |
| 5,132,166 | A | * | 7/1992 | Adams et al. | 428/212 |
| 5,228,546 | A | | 7/1993 | Chang et al. | 190/18 |
| 5,252,161 | A | | 10/1993 | Chang et al. | 156/196 |
| 5,284,542 | A | * | 2/1994 | Lee | 156/242 |
| 5,358,082 | A | * | 10/1994 | Armstrong, IV | 190/21 |
| 6,050,374 | A | * | 4/2000 | Johnston | 190/109 |
| 6,109,404 | A | * | 8/2000 | Bishop | 190/125 |
| 6,173,837 | B1 | * | 1/2001 | Marconi | 206/457 |

FOREIGN PATENT DOCUMENTS

| | | | | |
|---|---|---|---|---|
| DE | 2632589 A1 | * | 1/1978 | A45C/5/02 |
| FR | 2653313 A1 | * | 4/1991 | A45C/3/00 |
| WO | WO01/28381 A1 | * | 4/2001 | A34C/13/04 |

OTHER PUBLICATIONS

U.S. Appl. No. 10/324,828, filed Dec. 20, 2002.
U.S. Appl. No. 10/324,829, filed Dec. 20, 2002.

* cited by examiner

*Primary Examiner*—Sue A. Weaver
(74) *Attorney, Agent, or Firm*—Baker Botts LLP

(57) ABSTRACT

A light-weight side gusset for a bag includes a formed composite frame having a peripheral raised region and a depressed central region. An opening through the depressed central region forms a relatively narrow border portion around the inner periphery of the raised region. A central panel corresponding in configuration to the outline of the depressed region is attached to the border portion of the depressed region to cover the opening therethrough. The composite frame is made up of a moldable substrate, e.g. ethyl vinyl acetate foam, an outer layer wear-resistant material, e.g., high-denier nylon or poly/nylon combination, and, preferably, an inner adherent layer, e.g., the loop half of a hook-and-loop fabric. Methods of manufacturing the composite frame, a gusset including such frame, and a bag including such gusset are also disclosed.

51 Claims, 7 Drawing Sheets

GUSSET FOR A LIGHT-WEIGHT BAG AND A BAG ASSEMBLED THEREFROM

BACKGROUND OF INVENTION

1. Field of the Invention

The present invention relates to a light-weight formed side panel or gusset for luggage or other bags and to a luggage item or bag incorporating such light-weight side panels or gussets.

2. The Related Art

In the luggage or bag field, there are generally two basic types of construction: (1) hard body bags, in which the outer walls are made of a hard plastic material such as polyvinyl chloride (PVC), polyethylene (PE), polypropylene (PP), etc., and (2) soft body bags, in which the outer walls are made of a flexible material such as leather, vinyl, fabric, etc. Hard body bags have the advantage of resistance to deformation by external forces, which affords greater protection to the contents against damage. Such bags, however, tend to be unattractive in appearance or to the touch. They also tend to be relatively heavy.

Soft body bags, on the other hand, although agreeable in appearance and light in weight, often do not afford adequate protection to the contents against external forces. For greater resistance to deformation, rigid internal frames have been provided in soft body bags to maintain the shape of the bag. Such rigid internal frames, however, add significantly to manufacturing costs and also increase weight.

SUMMARY OF THE INVENTION

The foregoing and other disadvantages of the prior art are overcome by the present invention, which provides a light-weight gusset comprising a formed composite frame substantially corresponding in configuration to the outline of a side of the bag and being comprised of an intermediate substrate and a wear-resistant material adhered to the outer surface of the substrate. The region of the frame bordering the upper edge, the lower edge and the two side edges thereof is formed outwardly from the edges to define a raised region surrounding a depressed region centrally of the frame. The depressed central region has an opening therethrough forming a border portion of the depressed region around the interior periphery of the raised region. A central panel substantially corresponding in configuration to the outline of the depressed region is secured to the border portion of the depressed region of the frame so as to cover the opening therethrough.

The substrate is comprised of moldable synthetic material, preferably ethyl vinyl acetate foam. The wear-resistant material adhered to the outer surface of the substrate member is preferably a high-denier content fabric or other high-strength, non-stretchable material.

In one embodiment, the depressed central region of the frame extends over at least half of the distance between the two side edges, and over at least half of the distance between the upper and lower edges, of the frame. The opening in the depressed central region of the frame then preferably extends over substantially the full area of the depressed central region, whereby the border region of the depressed central region is relatively narrow in comparison to the size of the opening and functions as a seam allowance for the attachment thereto of the central panel. The raised region of the frame may be of substantially the same width along the upper edge and over at least the upper half of the side edges of the frame. The raised region of the frame, with its outer wear-resistant covering, serves as a bumper to protect the bag against damage.

As a feature of the invention, one or more indentations are formed in the raised region of the frame and correspond in configuration to an external component or components to be mounted on the frame. For example, the formed indentation may be located at least in part adjacent the lower rear edge of the frame and correspond in configuration to a wheel assembly to be mounted on the frame. Such formed indentation may also extend in part adjacent the side edge of the frame corresponding to the back of the bag for receipt of a wheel skid component. A second indentation formed in the raised region of the frame adjacent the lower edge thereof may correspond in configuration to a front support foot of the bag.

The central panel preferably comprises an inner stiffening member, an intermediate cushioning member, and an outer fabric covering. This structure of the central panel, together with the frame itself, lends stiffness and shape memory to the gusset against deformation under external load. In a preferred embodiment, the stiffening member, the cushioning member and the covering material are assembled together and secured as an assembly to the frame by sewing the assembled unit to the central border region of the frame.

In accordance with the invention, a bag assembled from the aforementioned gusset structure includes a body having a top, a bottom, a front, a back and two ends and a gusset attached to each of the two ends of the body to form the sides of the bag. The body of the bag is preferably made of soft material, e.g., nylon or poly/nylon combination, and is sewn to the upper, lower and two side edges of each gusset to complete the shell of the bag.

According to a further feature of the invention, a drop-in liner is provided to cover the inner surface of the bag. To facilitate the attachment of the liner within the bag, the inner surface of each gusset frame is preferably covered, at least in part, by an adherent material which adheres to the facing surface of the liner. Preferably, the adherent material on the gusset frame comprises the loop half of a hook-and-loop fastener fabric, although other types of adherent materials or even mechanical fasteners may be used to secure the liner to the gusset frames.

When an adherent material is provided on the inner surface of the gusset frames, the side of the liner facing each gusset frame is adapted, at least in the portion thereof overlying the border portion of the depressed region of the frame, to adhere to the adherent material on the frame, whereby the liner is attachable to the gusset at least around the inner periphery of the raised region thereof. The liner is preferably attached to the side edge of the gusset that is attached to the front of the bag. In such case, the side of the liner facing the gusset frame is adapted in the portion overlying at least in part the region of the frame bordering the edges of the frame attached to the top, bottom and back of the bag to adhere to the adherent material on the frame, whereby the liner is attachable to each gusset along the edges thereof attached to the top, bottom and back of the bag. Preferably, the aforementioned portions of the liner are adapted to adhere to the adherent material on the gusset by providing strips of the hook half of a hook-and-loop fastener fabric on the inner surface of the liner.

BRIEF DESCRIPTION OF THE DRAWINGS

For a better understanding of the invention, reference may be made to the following description of exemplary embodiments thereof, taken in conjunction with the accompanying drawings, in which.

DESCRIPTION OF EXEMPLARY EMBODIMENTS

Figure 1:
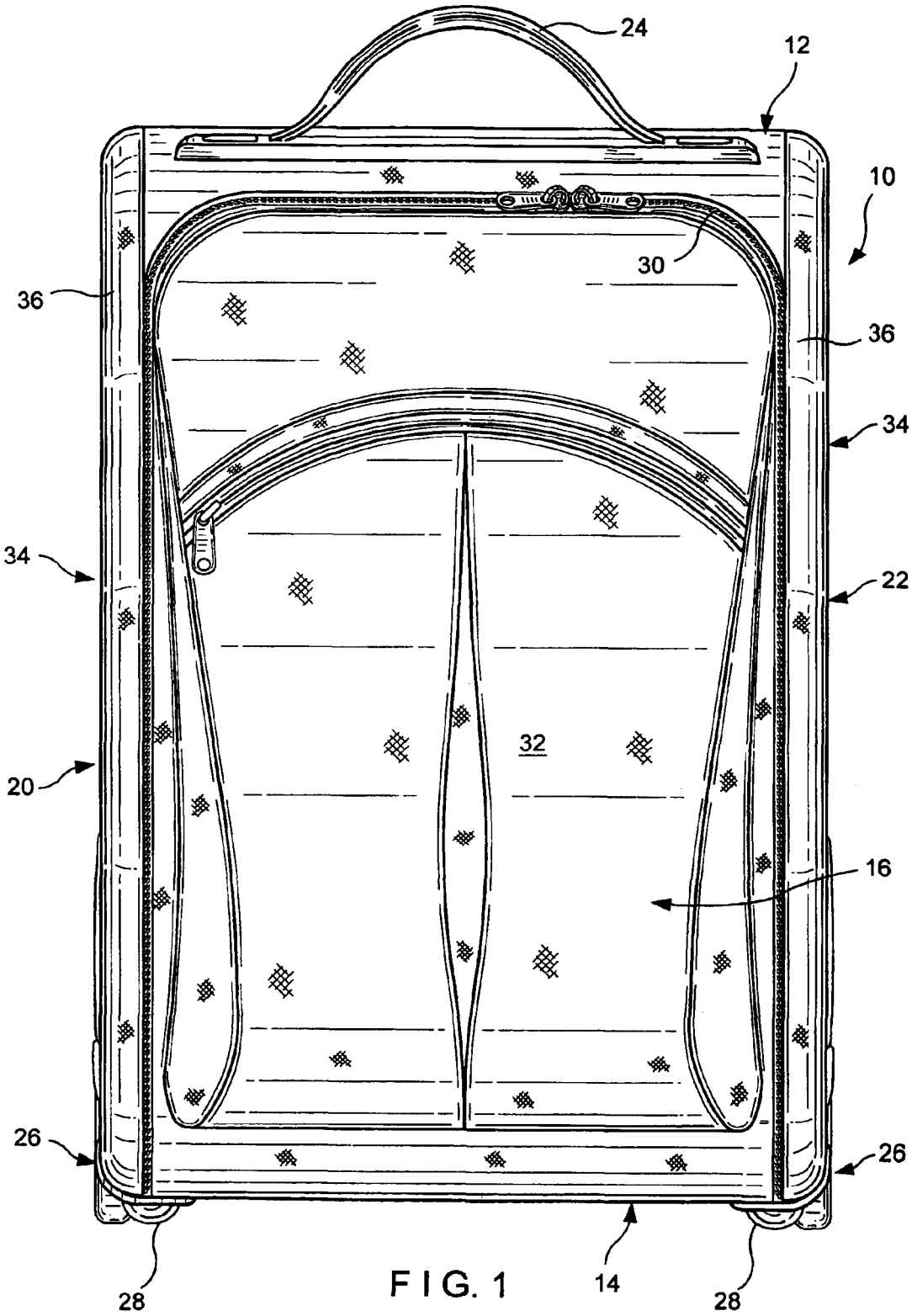
FIG. 1 is front view of an embodiment of a soft-body luggage item having sides comprised by light-weight formed gussets in accordance with one embodiment of the invention.
Figure 2:
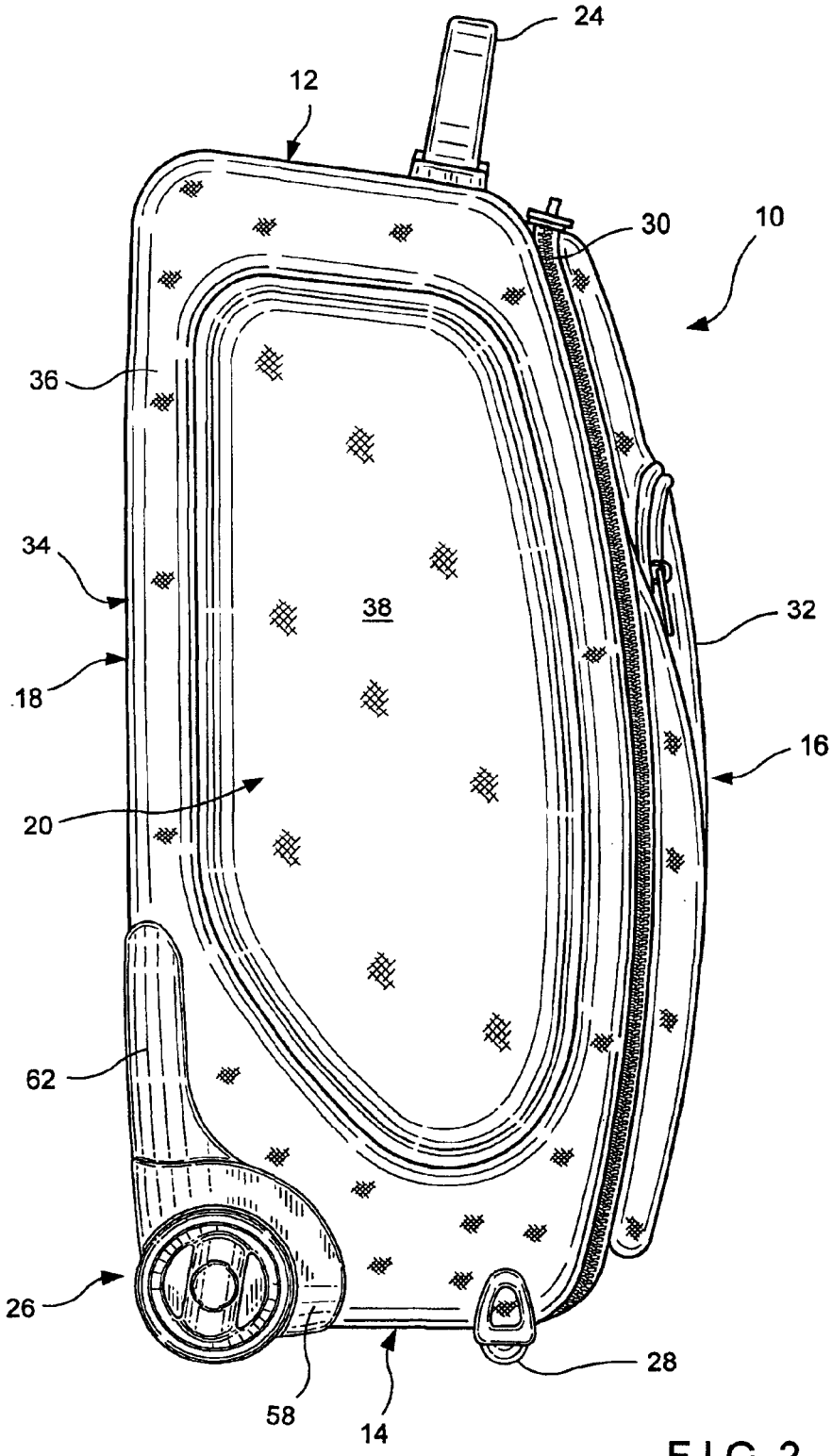
FIG. 2 is a left side view of the embodiment of the luggage item and the gusset of FIG. 1.

FIGS. 1 and 2 illustrate an embodiment of a bag 10 having a top 12, a bottom 14, a front 16, a back 18, a left side 20 and a right side 22. The top, bottom, front and back are preferably assembled together to form the body of the bag. At least the front 16 and the back 18 of the body are preferably made of a soft, wear-resistant material such as nylon or poly/nylon combination or other high-denier content material. The top 12 and the bottom 14 are likewise preferably covered by a soft, wear-resistant material, suitably the same material as the front and back, but may also include internal or external reinforcement members or, alternatively, may be constructed of a rigid material for greater strength.

Figure 3:
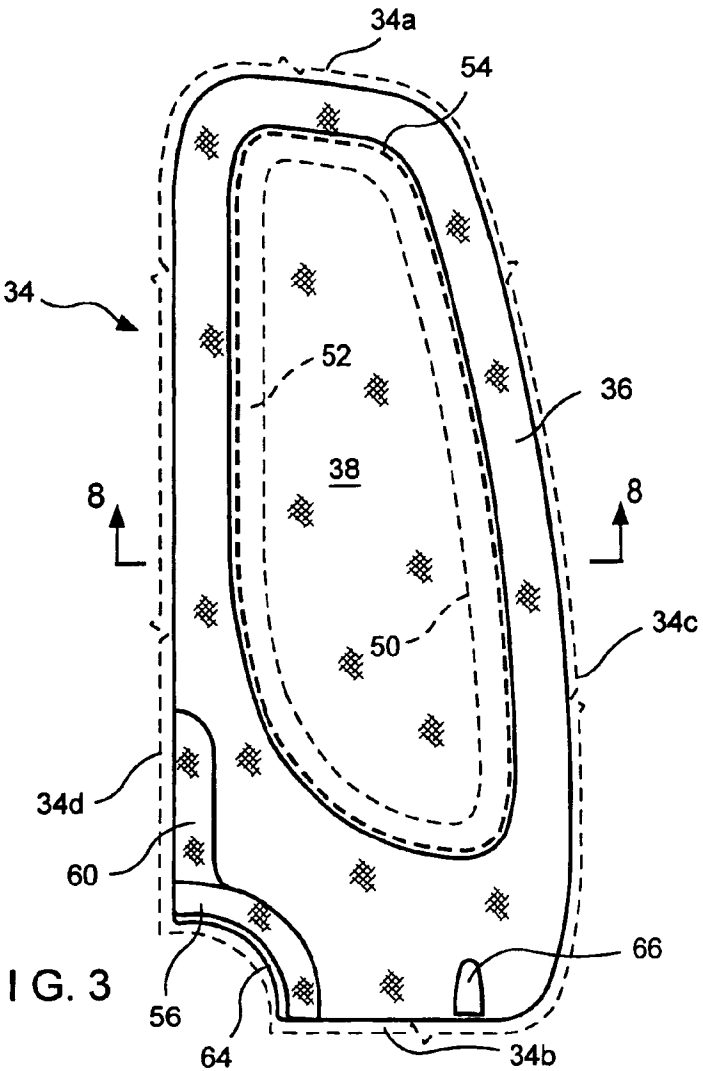
FIG. 3 is an outer side view of the embodiment of the gusset of FIG. 2, showing the gusset per se prior to assembly with the body of the bag.
Figure 8:
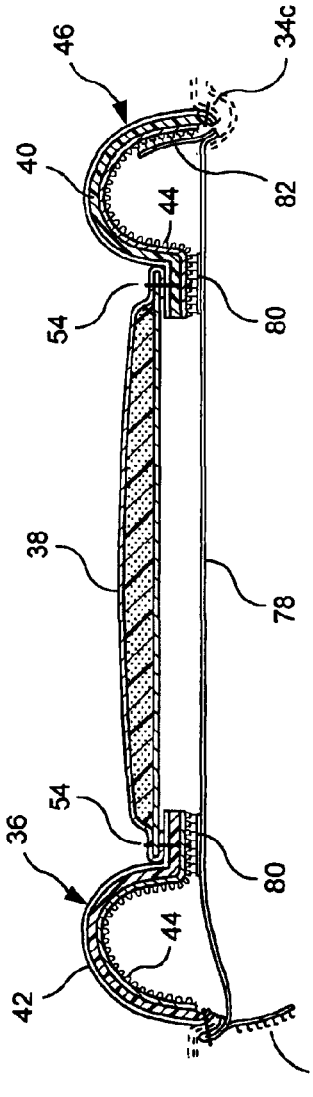
FIG. 8 is a cross-sectional view of the gusset of FIG. 3, taken along the line 8—8 and looking in the direction of the arrows.

A carry handle 24 is attached to the top 12 of the bag, and a wheel assembly 26 is mounted at the lower end of each side of the bag. If desired, a front foot 28 may be mounted near the front of each side to provide support for the bag 10 when free standing in the upright position shown. The bag includes a main compartment (not shown) accessible via a releasable closure mechanism such as a zipper 30, and may include one or more zippered pockets 32. In accordance with the invention, each of the bag sides 20, 22 is constituted by a gusset 34 which is sewn or otherwise suitably attached to the adjacent edges of the top 12, bottom 14, front 16 and back 18 of the bag body. FIGS. 3 and 8 illustrate the gusset 34 of the left side 20 of the bag 10 without the wheel assembly 26 and the front foot 28. The gusset for the right side has the same construction, but is the mirror image in configuration.

Figure 7:
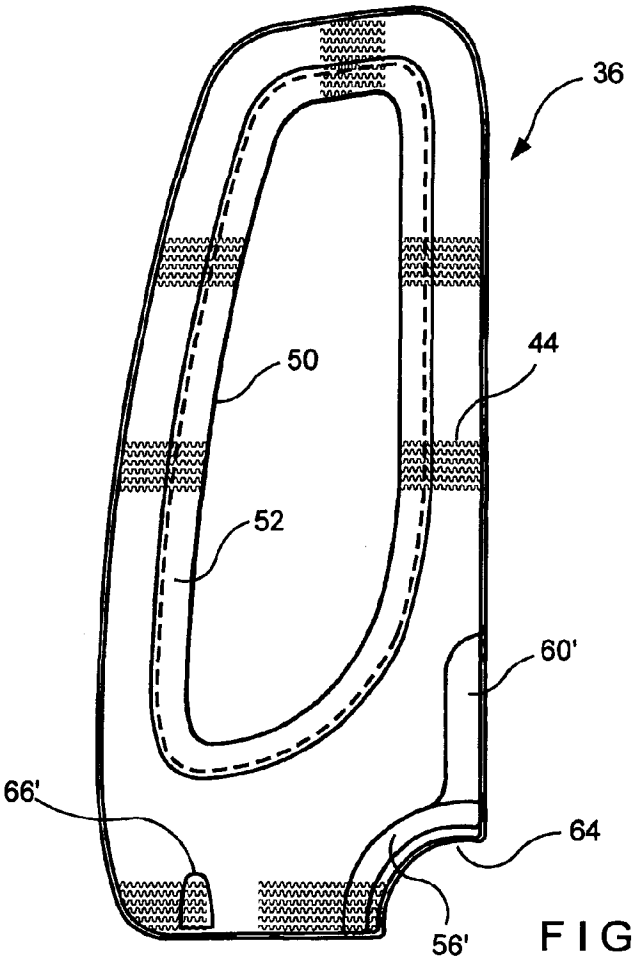
FIG. 7 is an inner side view of the composite frame of the gusset of FIG. 3 without the central panel.
Figure 6:
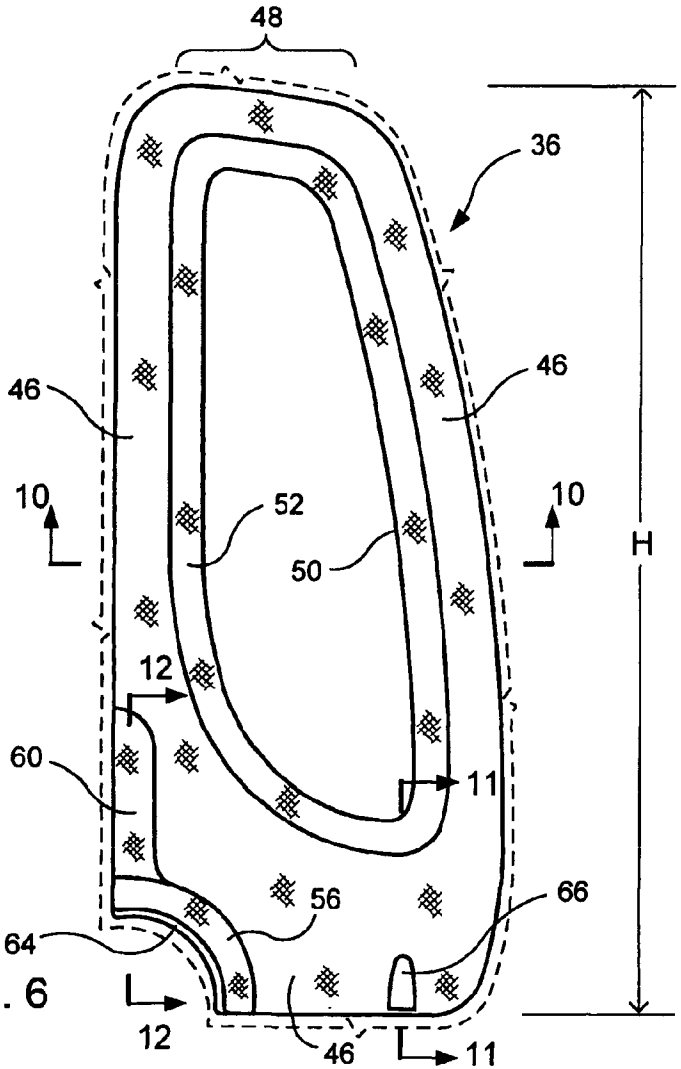
FIG. 6 is an outer side view of the composite frame of the gusset of FIG. 3 without the central panel.
Figure 10:
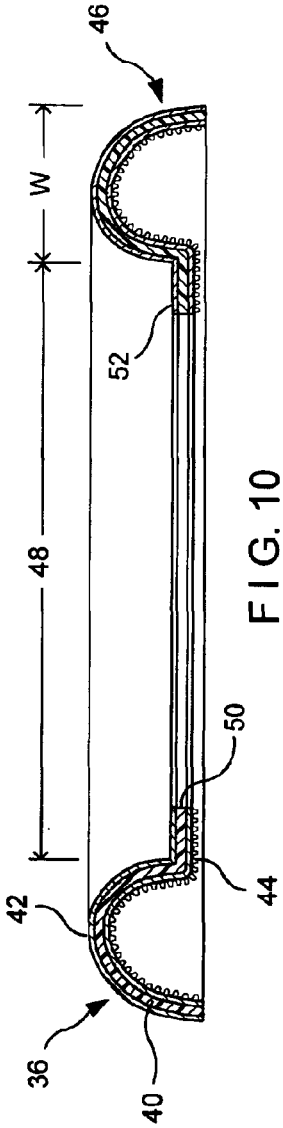
FIG. 10 is a cross-sectional view of the composite frame of FIG. 6, taken along the line 10—10 and looking in the direction of the arrows.

As shown in FIG. 3, the gusset 34 preferably includes a composite frame 36 and a central panel 38. The frame 36 per se is shown in FIGS. 6, 7 and 10. It is comprised of a composite body made up of a substrate 40, a wear-resistant material 42 on the outer surface thereof, and, preferably, an adherent material 44 on the inner surface thereof. The substrate 40 is preferably comprised of a light-weight moldable synthetic material such as ethyl vinyl acetate foam. Other suitable materials include other moldable foams, PVC, PP, PE or PC (polycarbonate). The material used preferably will have some degree of flexibility, i.e., shape memory. The outer wear-resistant material 42 is preferably a high-denier content fabric, such as nylon or poly/nylon combination. Alternatively, the wear-resistant material 42 may comprise a non-woven synthetic, such as polyvinyl chloride (PVC). The inner layer 44 preferably comprises the loop half of a hook-and-loop fastener material, e.g., Velmat™ fabric. Other suitable adherent materials may also be used, such as glue or two-sided adhesive tape.

As described hereinafter, the purpose of the adherent material 44 on the inner surface of the substrate 40 is to facilitate the attachment of a bag liner to the inner surface of the gussets 34. While it is advantageous for that purpose to use an adherent layer, such as the loop half of a hook-and-loop fastener, covering part or all of the inner surface of the substrate 40, it is not necessary to do so. If desired, the liner could be attached to the gussets 34 by mechanical fasteners such as snaps, zippers, buttons, rivets or a press fit.

Figure 11:
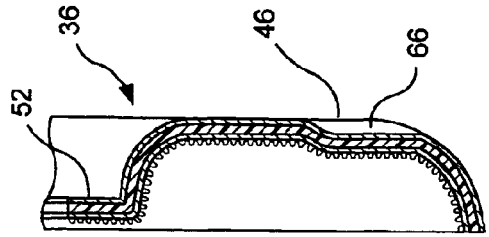
FIG. 11 is a partial cross-sectional view of the composite frame of FIG. 6, taken along the line 11—11 and looking in the direction of the arrows.
Figure 12:
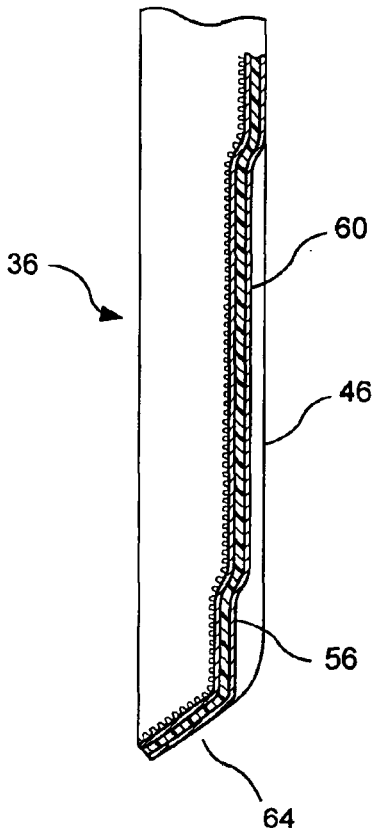
FIG. 12 is a partial cross-sectional view of the composite frame of FIG. 6, taken along the line 12—12 and looking in the direction of the arrows.

In a preferred embodiment, the frame 36 comprises a raised region 46 which extends around the outer periphery of the frame in surrounding relation to a depressed central region 48. As shown, the raised region 46 is approximately semicircular in cross section (FIG. 10), and of approximately the same width W, along the top and over at least the upper half of the height H of the frame 36. At the lower end of the frame 36, the raised region 46 has a flatter cross section (FIGS. 11 and 12). The wear-resistant material 42 is on the outer surface, and, where present, the loop fabric 44 is on the inner surface, of the raised region 46. The raised peripheral region 46 of the frame 36 and the wear-resistant material 42 thereon serve as a bumper to protect the bag and its contents against damage.

An opening 50 is formed through the depressed central region 48 of the frame 36, so as to leave a relatively narrow (compared to the width of the opening) seam allowance or border region 52 surrounding the inner periphery of the raised region 46. The depressed central region 48 preferably extends over at least half of the distance between the two side (front and rear) edges, and over at least half of the distance between the upper and lower edges, of the frame 36. For weight reduction, the opening 50 preferably extends over substantially the full area of the central region 48.

As shown in FIG. 8, the central panel 38 is sewn, as at 54, or otherwise affixed to the border region 52 to cover the opening 50. To that end, the central panel 38 is preferably coextensive in size and configuration with the outline of the central region 48 of the frame 36. The particular generally oblong design of the raised frame region 46, the depressed central region 48 and the central panel 38 shown in FIGS. 2 and 3 is illustrative only and is primarily ornamental in nature.

As one aspect of the invention, the provision of the composite frame 36 as a formed, or molded, body permits the formation thereon of one or more premolded indentations in the configuration of external members or components of the bag to be mounted on the frame 36. Thus, as shown in FIGS. 6 and 12, an indentation 56 in the configuration of a base portion 58 of a wheel assembly 26 (FIG. 2) may be molded in the raised region 46 at the lower end of the frame 36. If desired, a further indentation 60 may be molded in the raised region 46 along the rear edge of the frame 36 for mounting thereon of a rear skid 62, which may be an integral part of the wheel assembly 26 or a separate component. A curved cutout 64 may also be molded at the lower rear end of the frame 36 to provide a recess for the wheel of a wheel assembly 26. Still further, as shown in FIGS. 6 and 11, a premolded indentation 66 may be provided adjacent the lower front edge of the frame 36 for receipt of a front support foot 28. The provision of such premolded indentations and/or cutouts facilitates the accurate assembly of the wheel assemblies 26, support feet 28, and/or other external components on the frame 36.

It will be understood that indentations or outlines may be formed in the frame 36 for still other external components. In other styles of bags, e.g., non-wheeled bags, such indentations could be provided for handles, shoulder strap attachments, and the like.

In FIG. 7, which shows the inner surface of the composite frame 36, the indentations 56, 60, 66, etc., appear as protrusions 56', 60' and 66'. The adherent material 44 preferably covers the entire inner surface of the substrate 40, including the inner surface of the border region 52 of the central region 48. (See, also, FIG. 10.)

Figure 5:
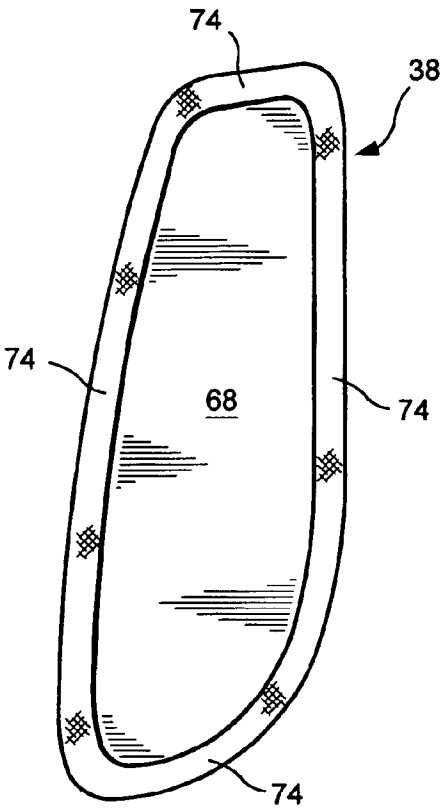
FIG. 5 is an inner side view of the central panel of the gusset of FIG. 3.
Figure 4:
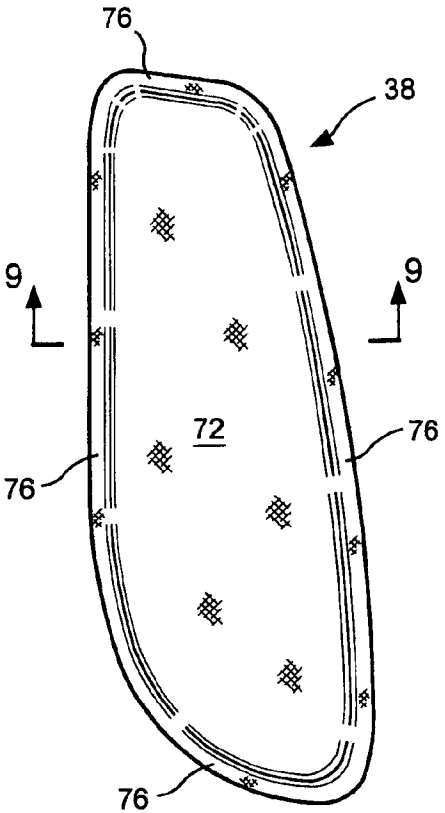
FIG. 4 is an outer side view of the central panel of the gusset of FIG. 3.
Figure 9:
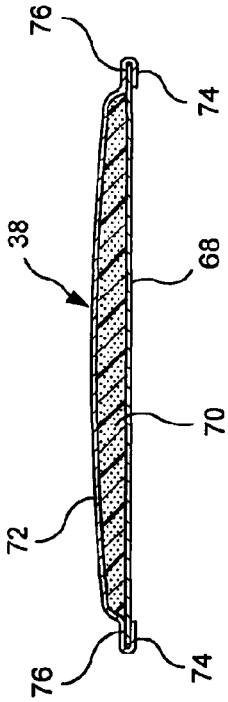
FIG. 9 is cross-sectional view of the central panel of FIG. 4, taken along the line 9—9 and looking in the direction of the arrows.

The construction of the central panel 38 is shown in detail in FIGS. 4, 5 and 9. In the embodiment there shown, the panel 38 comprises an inner stiffening member 68, an intermediate cushioning member 70 and an outer covering 72. The stiffening member 68 may consist of pressboard or other lightweight rigid material, which extends over the full inner side of the panel 38. The intermediate cushioning member 70 suitably is made of an open-cell foam material. It likewise extends over substantially the full extent of the panel 38. The outer covering 72 may comprise any suitable fabric or decorative material, and preferably is wear-resistant for longer life. It may or may not be the same material and/or color as the wear-resistant material 42 covering the frame 36.

The outer covering 72 is turned over the edges of the intermediate member 70 and the inner member 68, as shown at 74 in FIG. 5 and FIG. 9, all around the periphery of the panel 38, and is adhesively affixed to the inner surface of the inner member 68. Preferably, the cushioning member 70 is slightly smaller than the inner member 68, so that there is a narrow peripheral border 76 for stitching of the panel 38 to the border region 52 of the depressed central region 48 of the frame 36. The covering 72 may also be adhesively adhered to the upper surface of the inner member 68 in the border region 76 if desired. The inner member 68, the cushioning member 70, and the covering 72 are preferably preassembled as shown in FIG. 9, and then sewn as an assembled unit to the frame 36. As indicated in FIG. 8, the stitching 54 preferably extends through the layers of the material 72 both overlying and underlying the inner stiffening member 68, through the stiffening member 68 itself, and through the composite frame in the border regions 52 thereof.

The central panel 38 stiffens the frame 36 against crushing under external forces, without adding appreciably to the weight or cost of the bag. Together, the frame 36 and central panel 38 lend good shape memory to the gusset 34, allowing it to deform resiliently under external load and yet return the bag to its original shape when the load is removed. The object is to provide a "bend but not break" gusset structure which does not require an internal frame, lightens the overall weight of the bag, and allows greater design freedom in terms of shaping and coloration.

A fully formed and assembled gusset 34, as shown in FIG. 3 for the left hand side 20 of the bag 10, is sewn or otherwise attached along its upper edge 34*a*, lower edge 34*b*, front side edge 34*c* and back side edge 34*d* to the adjacent edges of each of the top, bottom, front and back of the body of the bag 10, thereby completing the shell of the bag. Thereafter, the wheel assemblies 26, the front support feet 28 and other external components are mounted on each gusset 34 as described above.

Figure 13:
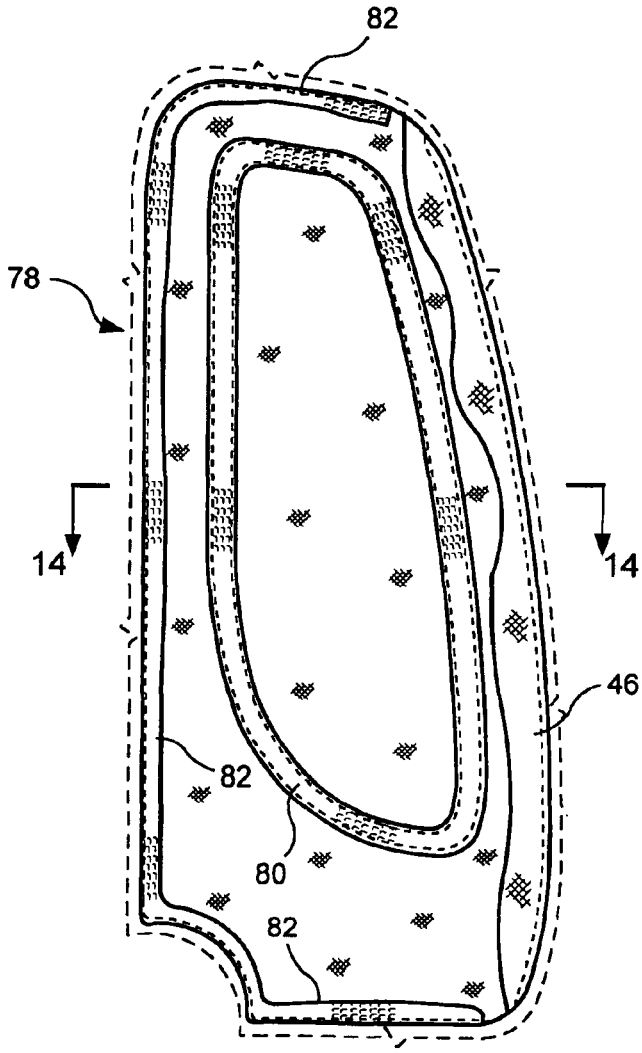
FIG. 13 is a side view of the portion of the liner intended to overlie the inner surface of the gusset of FIG. 3.
Figure 14:
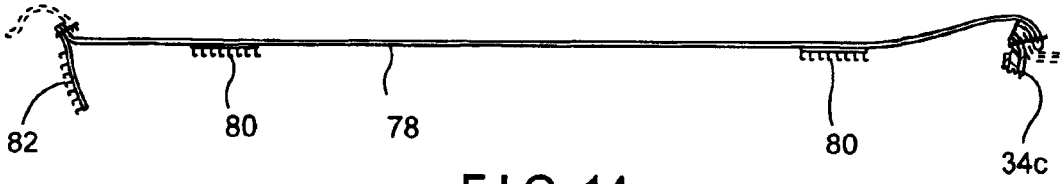
FIG. 14 is a cross-sectional view of the liner of FIG. 13, taken along the line 14—14 and looking in the direction of the arrows.

As a further feature of the invention, a liner 78 (FIGS. 8, 13 and 14) is fabricated separately of any appropriate liner material and is sewn to the front peripheral edge 34*c* of each gusset 34 at the time the gussets 34 are sewn to the body of the bag. The liner 78, as seen in FIG. 13 from the side facing the adjacent gusset 34, preferably includes at least in the portion thereof overlying the border region 52 of the central depressed region 48 of the frame 36 a strip 80 of the hook half of a hook-and-loop fastener fabric. Preferably, one or more strips 82 of hook fabric are also provided on the portions of the liner 78 overlying the edges of the composite frame 36 that are attached to the top, bottom and back edges of the bag. With the hook strips 80, 82 so positioned, the liner 78 may be quickly and securely attached to the gussets 34 by pressing the strips 80, 82 into engagement with the loop fabric 44 on the facing inner surface of the adjacent gusset 34, as illustrated in FIG. 8.

Although the use of hook-and-loop fabric to attach the liner 78 to the gusset 34 is preferred, as described above other adherent materials or even mechanical fasteners may be provided on the facing surfaces of the gusset frame 36 and/or the liner 78 to adapt such facing surfaces to adhere or attach to one another when pressed together.

According to another aspect of the invention, methods are provided for manufacturing the composite frame 36, which may be done as a separate preliminary manufacturing process, and for the assembly therefrom of a gusset 34 and a complete bag 10. The steps in the production of a composite frame are illustrated schematically in FIGS. 15 and 16.

As there shown, a composite sheet 84, comprising a moldable substrate having a layer of wear resistant material adhered to its upper surface and a layer of adherent material adhered to its lower surface, is assembled or positioned at station (a). The composite sheet 84 is moved to station (b) at which one or more incisions 86 are made in the central region of the sheet. The purpose of the incisions 86 is to allow the use of high-denier nylon or poly/nylon combination or other non-stretchable material as the wear-resistant material 42 on the outer surface of the frame 36. Because such materials 42 cannot stretch during the molding process, the incisions 86 are provided to allow the material 42 to pull apart in the central region of the sheet 84 during the molding of the raised region 46 of the frame 36. Otherwise, the non-stretchable wear-resistant material 42 would not conform to the raised cross section of the frame 36. The ability to use non-stretchable materials as the outer covering of the frame 36 is an advantageous feature of the invention, as it makes possible the use of high-strength, abrasion-resistant materials that significantly enhance the durability of the bag.

Figure 15:
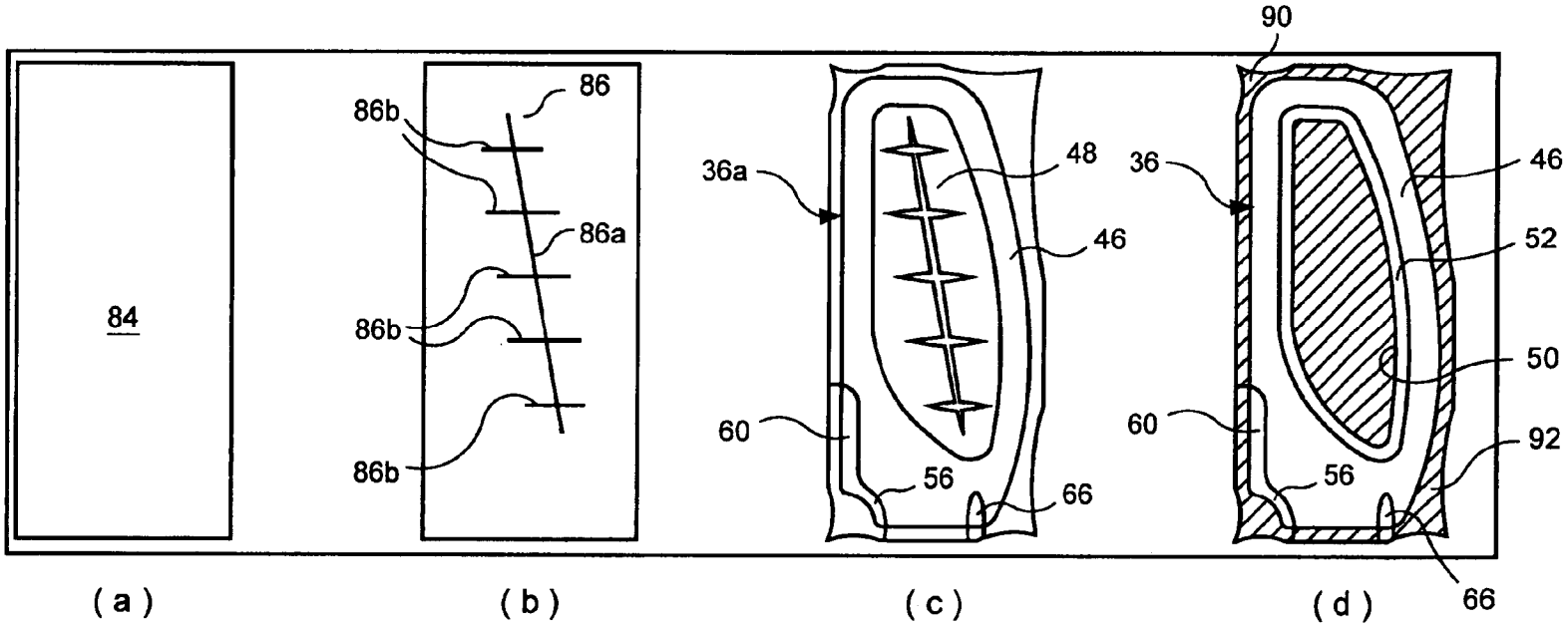
FIGS. 15 and 16 are schematic views illustrating the steps in the manufacture of the embodiment of the composite frame of FIGS. 6 and 7.

As shown at station (b) in FIG. 15, the incisions 86 preferably include a long central incision 86*a*, which extends generally lengthwise of the intended depressed central region 48 of the frame 36, and a plurality of cross incisions 86*b*. Although it is necessary only for the incisions 86 to extend through the non-stretchable wear-resistant material 42, they are preferable made through the substrate 40 and, where present, the adherent layer 44 as well. The incisions may be made in any suitable manner, as, for example, by a reciprocating cutting tool 88 as shown in FIG. 16.

Figure 16:
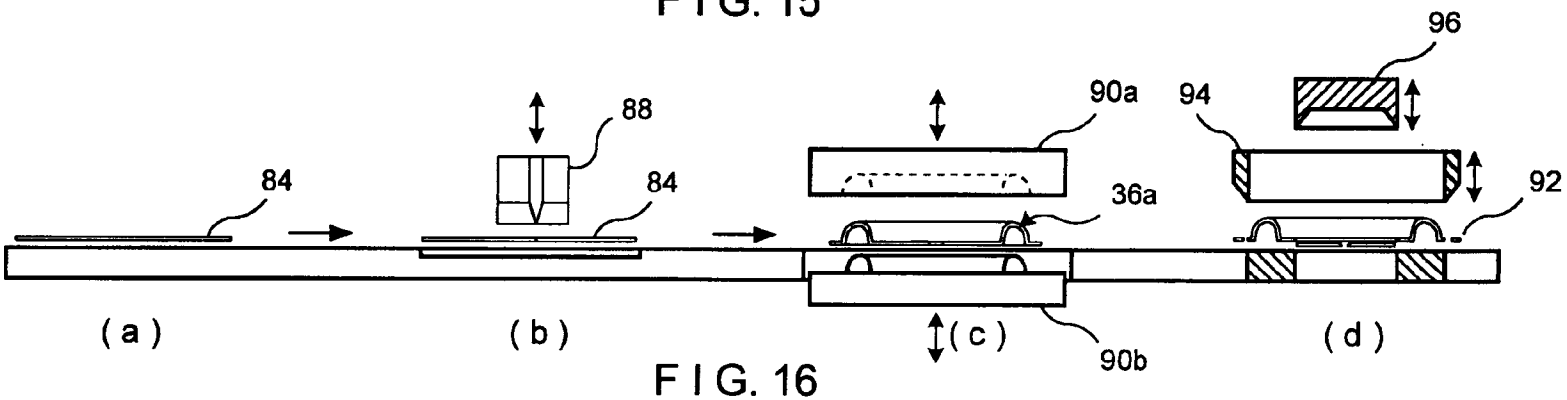

The molding step itself is illustrated at station (c) in FIGS. 15 and 16. As there shown, two separate mold valves 90*a* and 90*b* are pressed together under the appropriate conditions of heat and pressure to form a frame blank 36*a* having the raised peripheral region 46 and the depressed central region 48 of the frame 36. During such step, the incisions 86 through the composite sheet 84 allow the non-stretchable wear-resistant material 42 (or the entire sheet if the incisions extend therethrough) to separate along the incisions both lengthwise and widthwise of the frame, thereby permitting the composite sheet 84 to take the cross-sectional configuration depicted in FIGS. 6, 7 and 10. The indentations 56, 60 and 66, etc., are also formed at the same time. Any conventional molding process suitable for use with the materials of the substrate 40, the wear-resistant material 42, and the adherent material 44 may be used to form the composite sheet 84 into the frame blank 36*a*.

Thereafter, the mold halves 90*a* and 90*b* are separated, and the frame blank 36*a* is cooled, if necessary, and moved to station (d), where the excess material 92 around the outer periphery of the frame 36 is trimmed and the central opening 50 is cut through the blank 36*a* by the cutting tools 94 and 96, respectively. The resulting product is the completed left-side composite frame 36 of FIGS. 6, 7 and 10. A right-side frame would be made in the same way, using approximately shaped mold halves and cutting tools. If desired, the trimming step could be carried out as a separate later step, for example, at the bag assembly site.

If the raised peripheral region 46 of the frame 36 is shallow, i.e., of relatively low height, or the frame 36 is relatively small, it may be possible to omit the incisions 86 while still achieving the desired shaping of the outer covering material 42.

The completed left-side and right-side composite frames are transported to a gusset assembly station (not shown) at which a central panel 38, preferably in the form of a preassembled unit as shown in FIG. 9, is attached to each frame as shown in FIG. 8 to form the completed gusset 34. Thereafter, the left-side and right-side gussets are attached to the adjacent edges of the body of the bag to complete the shell of the bag. At the same time, the liner 78 is attached to the front edges of the gussets and dropped into the body of the bag, where the liner portions overlying the border regions 52 and/or the top, bottom and back edges of the gussets are pressed against the adherent material on the inner surface of the gussets, or are otherwise attached to the gussets, to secure the liner 78 in place within the body of the bag. Finally, the external components, such as the wheel assemblies 26, front feet 28, etc., are mounted on the external surfaces of the gussets to complete the assembly of the bag.

In accordance with the invention, the completed bag is made of low-cost, lightweight materials using economical manufacturing and assembly techniques. Further, it is of a construction which is both durable and resistant to external forces, without requiring a rigid internal frame. It uniquely combines the lightness and attractiveness of soft body bags with the protectiveness and shape retention of hard body bags.

Although the invention has been described and illustrated herein by reference to specific embodiments thereof, it will be understood that such embodiments are susceptible of variation and modification without departing from the inventive concepts disclosed. All such variations and modifications, therefore, are intended to be included within the spirit and scope of the appended claims.

What is claimed is:

1. A gusset for a bag, comprising:

a formed composite frame substantially corresponding in configuration to the outline of a side of the bag and having an inner surface, an outer surface, an upper edge, a lower edge and two side edges, the composite frame comprising an intermediate substrate and a wear-resistant material adhered to an outer surface of the substrate;

a region of the frame bordering the upper edge, the lower edge and the two side edges thereof being formed outwardly from said edges to define a raised region surrounding a depressed region centrally of the frame;

the depressed central region having an opening therethrough forming a border portion of the depressed region around the interior periphery of the raised region; and a central panel substantially corresponding in configuration to the outline of the depressed region and secured to the border portion of the depressed region of the frame and covering the opening therethrough.

2. The gusset of claim 1, wherein the substrate is comprised of moldable synthetic material.

3. The gusset of claim 2, wherein the synthetic material is ethyl vinyl acetate foam.

4. The gusset of claim 1, wherein the wear-resistant material adhered to the outer surface of the substrate is a non-stretchable fabric.

5. The gusset of claim 4, wherein the non-stretchable fabric is a high-denier content fabric.

6. The gusset of claim 5, wherein the non-stretchable fabric is a nylon or poly/nylon combination.

7. The gusset of claim 1, wherein the wear-resistant material adhered to the outer surface of the substrate is a non-woven synthetic material.

8. The gusset of claim 1, wherein the depressed central region of the frame extends over at least half of the distance between the two side edges, and over at least half of the distance between the upper and lower edges, of the frame.

9. The gusset of claim 8, wherein the opening in the depressed central region of the frame extends over substantially the full area of the depressed central region, whereby the border portion of the depressed central region is relatively narrow in comparison to the size of the opening.

10. The gusset of claim 1, wherein the raised region of the frame is of substantially the same width along the upper edge and over at least the upper half of the side edges of the frame.

11. The gusset of claim 1, further comprising at least one formed indentation in the raised region of the frame corresponding in configuration to an external member to be mounted on the frame.

12. The gusset of claim 11, wherein the formed indentation is located at least in part adjacent the lower edge of the frame and corresponds in configuration to a wheel assembly to be mounted on the frame.

13. The gusset of claim 12, wherein the formed indentation also extends in part adjacent the side edge of the frame corresponding to a back region of the bag.

14. The gusset of claim 12, further comprising a second indentation formed in the raised region of the frame adjacent the lower edge thereof and corresponding in configuration to a front support foot of the bag.

15. The gusset of claim 1, wherein the central panel is stitched to the border portion of the depressed central region of the frame.

16. The gusset of claim 1, wherein the central panel comprises an inner stiffening member, an intermediate cushioning member, and an outer covering material.

17. The gusset of claim 16, wherein the stiffening member of the central panel is comprised of press board, the cushioning member is comprised of open-cell foam material, and the covering material is a fabric.

18. The gusset of claim 16, wherein the stiffening member, the cushioning member and the covering material are assembled together and secured as an assembly to the frame.

19. The gusset of claim 1, wherein the central panel is recessed below the level of the raised region of the frame.

20. The gusset of claim 1, wherein the combined structure of the composite frame and the central panel flexes under external load but exhibits shape-memory to restore the outline of the gusset upon relief of the external load.

21. The gusset of claim 1, wherein the composite frame further comprises an adherent material on an inner surface of the substrate.

22. The gusset of claim 21, wherein the adherent material is the loop half of a hook-and-loop fabric.

23. A bag, comprising:

(a) a body having a top, a bottom, a front, a back and two ends; and (b) a gusset attached to each of the two ends of the body, each gusset comprising (1) a formed composite frame substantially corresponding in configuration to the outline of one end of the bag and having an inner surface, an outer surface, an upper edge, a lower edge and two side edges, the composite frame comprising an intermediate substrate and a wear-resistant material adhered to an outer surface of the substrate;

(2) the region of the frame bordering the upper edge, the lower edge and the two side edges thereof being formed outwardly from said edges to define a raised region surrounding a depressed region centrally of the frame;

(3) the depressed central region having an opening therethrough forming a border portion of the depressed region around the interior periphery of the raised region; and (4) a central panel substantially corresponding in configuration to the outline of the depressed region and secured to the border portion of the depressed region of the frame and covering the opening therethrough; and (c) each gusset being attached at its upper edge, lower edge and two side edges to the top, bottom, front and back, respectively, of the body and extending therebetween to form one end of the bag.

24. The bag of claim 23, wherein the substrate is comprised of moldable synthetic material.

25. The bag of claim 24, wherein the synthetic material is ethyl vinyl acetate foam.

26. The bag of claim 23, wherein the wear-resistant material adhered to the outer surface of the substrate is a non-stretchable fabric.

27. The bag of claim 26, wherein the non-stretchable fabric is a high-denier content fabric.

28. The bag of claim 27, wherein the non-stretchable fabric is a nylon or poly/nylon combination.

29. The bag of claim 23, wherein the wear-resistant material adhered to the outer surface of the substrate is a non-woven synthetic material.

30. The bag of claim 23, wherein the composite frame further comprises an adherent material on an inner surface of the substrate.

31. The bag of claim 30, wherein the adherent material is the loop half of a hook-and-loop fabric.

32. The bag of claim 23, wherein the depressed central region of the frame extends over at least half of the distance between the two side edges, and over at least half of the distance between the upper and lower edges, of the frame.

33. The bag of claim 32, wherein the opening in the depressed central region of the frame extends over substantially the full area of the depressed central region, whereby the border portion of the depressed central region is relatively narrow in comparison to the size of the opening.

34. The bag of claim 23, wherein the raised region of the frame is of substantially the same width along the upper edge and over at least the upper half of the side edges of the frame.

35. The bag of claim 23, further comprising at least one formed indentation in the raised region of the frame corresponding in configuration to an external member to be mounted on the frame.

36. The bag of claim 35, wherein the formed indentation is located at least in part adjacent the lower edge of the frame and corresponds in configuration to a wheel assembly to be mounted on the frame.

37. The bag of claim 36, wherein the formed indentation also extends in part adjacent the side edge of the frame attached to the back of the bag.

38. The bag of claim 36, further comprising a second indentation formed in the raised region of the frame adjacent the lower edge thereof and corresponding in configuration to a front support foot of the bag.

39. The bag of claim 23, wherein the central panel is stitched to the border portion of the depressed central region of the frame.

40. The bag of claim 23, wherein the central panel comprises an inner stiffening member, an intermediate cushioning member, and an outer covering material.

41. The bag of claim 40, wherein the stiffening member of the central panel is comprised of press board, the cushioning member is comprised of open-cell foam material, and the covering material is a fabric.

42. The bag of claim 40, wherein the stiffening member, the cushioning member and the covering material are assembled together and secured as an assembly to the frame.

43. The bag of claim 23, wherein the central panel is recessed below the level of the raised region of the frame.

44. The bag of claim 23, wherein the combined structure of the composite frame and the central panel of each gusset flexes under external load but exhibits shape-memory to restore the outline of the bag upon relief of the external load.

45. The bag of claim 23, wherein at least the front and the back of the body are made of soft material.

46. The bag of claim 45, wherein the soft material is a ballistic nylon.

47. The bag of claim 23, wherein the upper, lower and two side edges of each gusset are sewn to the ends of the top, bottom, front and back, respectively, of the body.

48. The bag of claim 23, further comprising a liner covering the inner surface of the composite frame of each gusset and being attached to the composite frame.

49. The bag of claim 48, wherein the composite frame further comprises an adherent material on an inner surface of the substrate; and the side of the liner facing the composite frame is adapted, at least in the portion thereof overlying the border portion of the depressed region, to adhere to the adherent material on the composite frame, whereby the liner is attachable to the gusset at least around the inner periphery of the raised region thereof.

50. The bag of claim 49, wherein:

the liner is attached to the side edge of the gusset that is attached to the front of the bag; and the side of the liner facing the composite frame is adapted, in the portion overlying at least in part the region of the composite frame bordering the edges of the composite frame attached to the top, bottom and back of the bag, to adhere to the adherent material on the composite frame, whereby the liner is attachable to the gusset along the edges thereof attached to the top, bottom and back of the bag.

51. The bag of claim 49, wherein:

the adherent material on the composite frame is the loop half of a hook-and-loop fabric; and at least said portions of the liner being adapted to adhere to the adherent material on the composite frame having affixed thereto the hook half of the hook-and-loop fabric.

* * * * *